US005279126A

United States Patent [19]

Holladay

[11] Patent Number: 5,279,126

[45] Date of Patent: Jan. 18, 1994

[54] DIFFUSER-COMBUSTOR

[75] Inventor: Thomas E. Holladay, Lake Park, Fla.

[73] Assignee: United Technologies Corporation, Hartford, Conn.

[21] Appl. No.: 995,405

[22] Filed: Dec. 18, 1992

[51] Int. Cl.[5] ..... F02C 7/00

[52] U.S. Cl. ..... 60/751

[58] Field of Search ..... 60/751, 39.36, 39.75

[56] References Cited

U.S. PATENT DOCUMENTS

| | | | |
|---|---|---|---|
| 2,833,115 | 5/1958 | Clarke et al. | 60/751 |
| 3,088,279 | 5/1963 | Dierich | 60/39.36 |
| 3,581,492 | 6/1971 | Norgren et al. | 60/751 |
| 3,631,674 | 1/1972 | Taylor | 60/39.36 |
| 3,877,221 | 4/1975 | Lefebvre et al. | 60/751 |
| 4,527,221 | 7/1985 | Markowski | 60/39.36 |
| 4,704,869 | 11/1987 | Iizuka et al. | 60/751 |
| 5,094,069 | 3/1992 | Boffo | 60/39.36 |
| 5,187,931 | 2/1993 | Taylor | 60/751 |

FOREIGN PATENT DOCUMENTS

| | | | |
|---|---|---|---|
| 2120325 | 11/1983 | United Kingdom | 60/751 |

*Primary Examiner*—Richard A. Bertsch
*Assistant Examiner*—Timothy S. Thorpe
*Attorney, Agent, or Firm*—Robert E. Greenstien

[57] ABSTRACT

A gas turbine engine has a combustor section using an axial prediffuser with an off-axis cowl passage formed by a diffuser outer wall and a combustor outer cowl. Flow from the prediffuser is split into intermediate outer and inner shroud passages and then the intermediate outer passage is further split into a outer shroud passage and a combustor cowl passage which supplies air to the fuel nozzles. The outer passage and cowl flow split is delayed to improved pressure supply and flow distribution to the outer passage.

3 Claims, 2 Drawing Sheets

DIFFUSER-COMBUSTOR

TECHNICAL FIELD

This invention relates to gas turbines, in particular, axial diffuser-combustors for gas turbines.

BACKGROUND OF THE INVENTION

In a typical gas turbine engine, compressor air is discharged into a prediffuser, which is part of a combustion section and serves to convert a portion of dynamic pressure to static pressure. A dump diffuser receives the air at the prediffuser exit and supplies it to and around an aerodynamically-shaped cowl, located ahead of the combustion chamber (combustor), typically separating the air into three branches. One branch is the cowl passage to supply air to fuel nozzles and for dome cooling. The other branches are outer and inner diameter (ID and OD) shroud passages, respectively, where air is introduced into the combustor for cooling and to complete the combustion process. A small portion of each of these shroud's air bypasses the combustor and is used for turbine cooling.

Different combustor designs are shown in the prior art, for instance, in U.S. Pat. No. 4,527,386, also assigned to the assignee of the application. So-called "axial combustors" use a configuration in which the prediffuser and combustor inner and outer liners are generally located symmetrically around the burner axis, resulting in the prediffuser and the cowl passage being approximately axially aligned. This design has been successfully applied in low and moderate temperature rise combustors. But, in high temperature rise combustors a greater portion of the airflow is introduced through the front of the combustor, i.e., through the cowl, creating flow conditions with reduced air flow for the shrouds. Two interesting results arise from this: First, shroud passages are designed to minimize both shroud pressure loss and weight, and when shroud flow is reduced, shroud height (area) is reduced accordingly, so much so that increased manufacturing tolerances may occasion significant variations in shroud pressure recovery, resulting in significant variations in air flow and distribution. Second, air flow entering the combustor cowl passage—the point closest to the prediffuser—is taken from the center of the prediffuser, where the total (dynamic plus static) pressure is higher than near-prediffuser-wall air which feeds the shrouds, resulting is lower pressure recovery in the shrouds.

DISCLOSURE OF THE INVENTION

Among the objects of the present invention is providing an improved diffuser-combustor design.

According to the present invention, air leaving the prediffuser is divided into two paths, with one branch containing all ID shroud air, and the other branch carrying the combined airflows for the cowl and the OD shroud. Further downstream, the second branch is divided into two new branches: the cowl, now off-axis, and the OD shroud.

A feature of the invention is that the skewed velocity profile exiting the prediffuser is smoothed out across the intermediate outer shroud passage, producing improved diffuser performance. During the smoothing process, momentum is transferred from the cowl-destined airflow, producing higher total shroud pressure and therefore improving pressure recovery and flow distribution. Another feature of the current invention is that it places a smooth cylindrical surface downstream of the prediffuser exit, as compared to the typical open cowl that is found behind the prediffuser in state-of-the-art designs, and this curved, solid surface eliminates the possibility of cowl spillage at an axially located combustor inlet, which disturbs shroud flow. Finally, the smooth surface present at the prediffuser exit is tolerant of prediffuser-exit velocity-profile changes in that the surface allows for a relocation of the stagnation point without hurting diffusion efficiency.

Other objects, features, and benefits of the invention will be apparent to one skilled in the art from the following discussion, wherein:

BEST MODE FOR CARRYING OUT THE INVENTION

Figure 1:
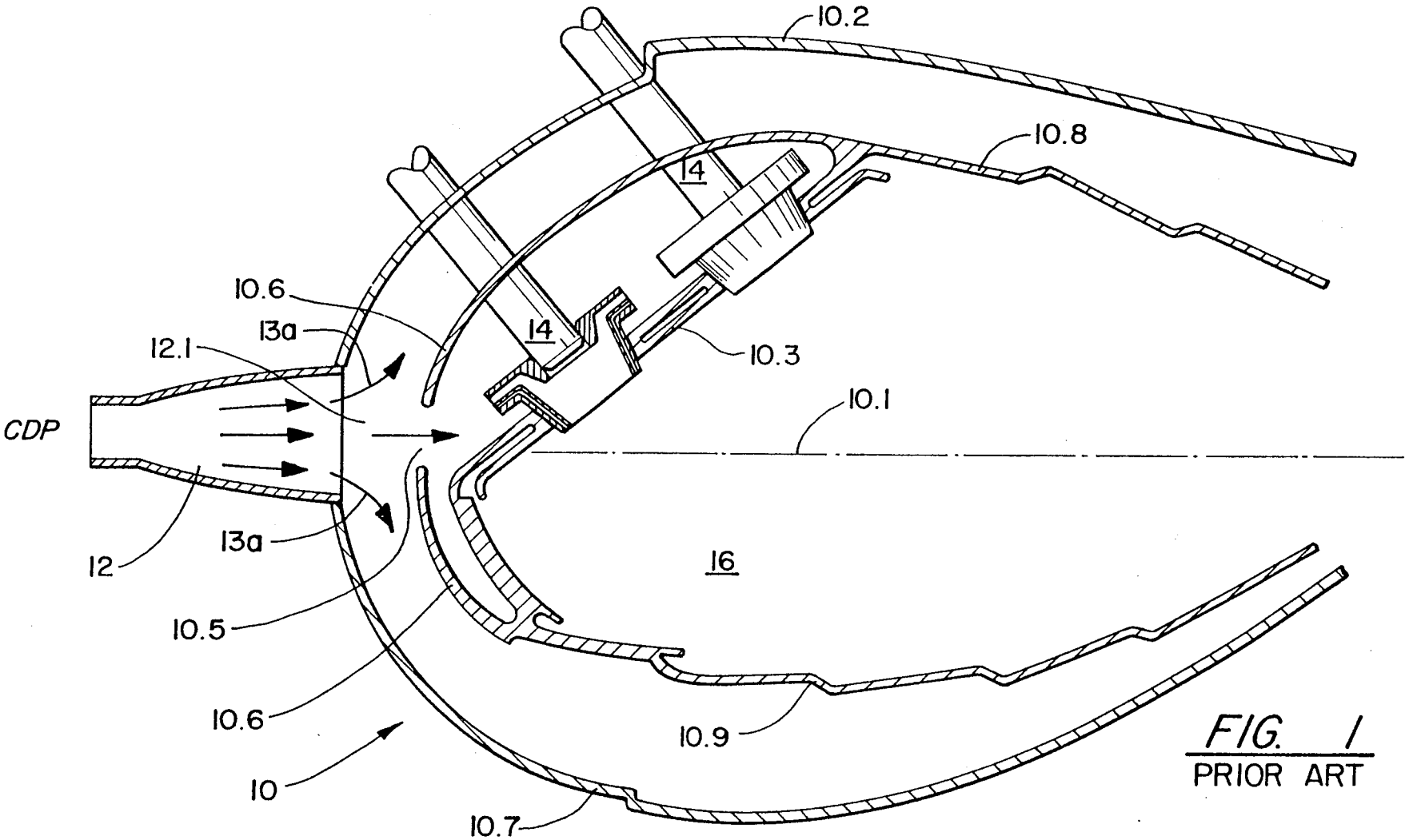
FIG. 1 PRIOR ART
FIG. 1 is section of an axial diffuser-combustor embodying a prior art design.

Referring to FIG. 1, the combustor section consists of a prediffuser 12, a dump diffuser 12.1, an outer wall 10.2, inner wall 10.7, combustor 16, and fuel nozzles 14. The combustor consists of outer liner 10.8, inner liner 10.9, outer cowl 10.6, inner cowl **10.6*a*, and dome 10.3. Inner and outer cowls 10.6 and 10.6*a* form cowl passage 10.5. Outer wall 10.2 and outer cowl 10.6 plus combustor outer liner 10.8 form outer shroud passage 13*a*. Inner wall 10.7 and inner cowl 10.6*a* plus combustor inner liner 10.9 form inner shroud passage 13*b***.

Figure 2:
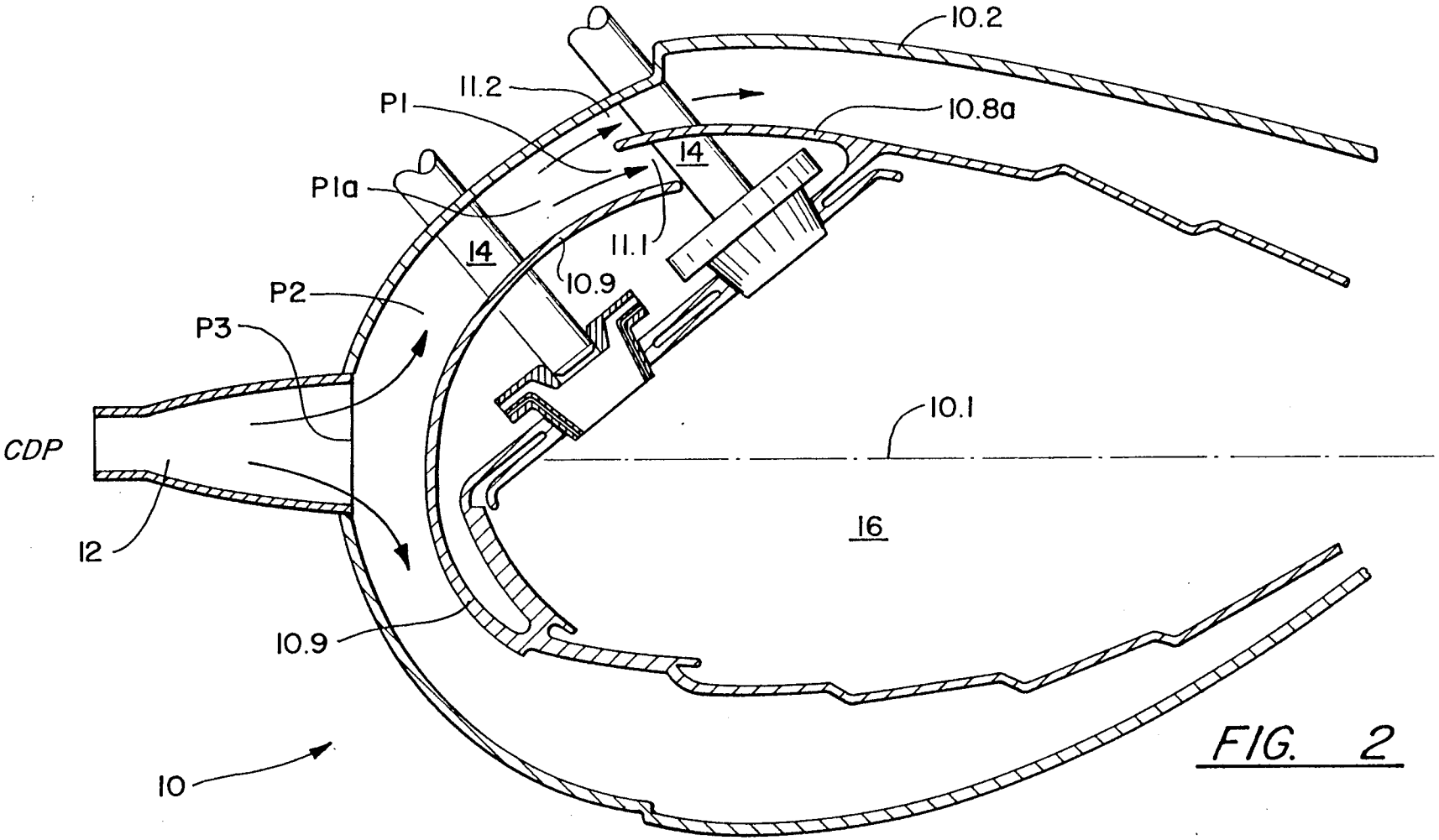
FIG. 2 is a section of an axial diffuser-combustor embodying the present invention.

In embodiment of the invention is shown in FIG. 2, the inner cowl 10.9 and the outer wall 10.2 form intermediate outer shroud passage for flow P2 from flow P3. The flow is split by an outer cowl **10.8*a* creating two paths, an off-axis cowl passage 11.1 and outer shroud passage 11.2, one going to the nozzles, the other going to the outer shroud passage as shown. Flow path P1** diverges to achieve further diffusion and recovery of dynamic pressure.

The pressure across the prediffuser at P3 in both embodiments is uneven but in the prior art the cowl inlet 10.5 receives air from the peak of the profile, which has the larger dynamic pressure. In the embodiment in FIG. 2, however, the dynamic pressure across the passage at P2 is substantially higher because it is an average of the pressure at locations **13*a* and 10.5 in the prior art design (FIG. 1). As the air flows to position P1 the variation in pressure across the passage is substantially reduced. As a result it is far simpler to determine the correct level of flow diversion at P1*a* and locate the diverter 10.8*a* appropriately between outer wall 10.2 and cowl 10.9 to achieve smooth flow for the air flowing into path 11.2 and for proper flow into the nozzle path 11.1. Further, the pressure in passage 11.2 is significantly higher because of the improved uniformity at P1** resulting in lower overall combustor section pressure loss.

I claim:

1. A gas turbine combustor section having a combustor shell and having a prediffuser positioned along a prediffuser longitudinal axis characterized by:

a liner located inside the combustor shell at first distance from the combustor shell to define an airflow path between the liner and the combustor shell that extends downstream from the prediffuser around a longitudinal axis of the combustor section, the liner having an interior defining a combustor;

a fuel nozzle located in the interior of the liner; and the liner containing a split at a location downstream from the prediffuser, and off the prediffuser longitudinal axis, ends of the liner at said split being separated to create a cowl that diverts a portion of airflow from the prediffuser diffuser to the fuel nozzle.

2. A gas turbine combustor section according to claim 1, further characterized in that:

the cowl comprises a first section of the liner at a first distance from the combustor shell, a second section at a second distance from the combustor shell, the second distance being less than the first distance, the first section being upstream from the second section and extending from a location behind the prediffuser to the cowl and the second section extending from the cowl to an end of the combustor section.

3. A gas turbine combustor section according to claim 2 further characterized in that the liner comprises a smooth unbroken, surface extending arcuately from a location behind the prediffuser to the cowl and the fuel nozzle is located on a wall extending between the first and second sections.

* * * * *